United States Patent [19]

Spaller

[11] Patent Number: 4,630,515

[45] Date of Patent: Dec. 23, 1986

[54] APPARATUS FOR CUTTING CONTINUOUS STRAND

[75] Inventor: Albert E. Spaller, Johnson City, Tenn.

[73] Assignee: Eastman Kodak Company, Rochester, N.Y.

[21] Appl. No.: 787,561

[22] Filed: Oct. 15, 1985

[51] Int. Cl.[4] ..... D01G 1/04

[52] U.S. Cl. ..... 83/402; 83/411 R; 83/346; 83/349; 83/913

[58] Field of Search ..... 83/402, 411 R, 411 A, 83/341, 343, 346, 349, 443, 444, 913

[56] References Cited

U.S. PATENT DOCUMENTS

| | | | |
|---|---|---|---|
| 4,169,397 | 10/1979 | Vehling et al. | 83/402 |
| 4,237,758 | 12/1980 | Lindner et al. | 83/913 |
| 4,367,084 | 1/1983 | Cox et al. | 83/913 |
| 4,519,281 | 5/1985 | Spaller | 83/346 |

*Primary Examiner*—Frank T. Yost
*Assistant Examiner*—Hien H. Phan
*Attorney, Agent, or Firm*—Malcolm G. Dunn; William P. Heath, Jr.

[57] ABSTRACT

Apparatus for cutting a continuous strand into predetermined lengths, wherein a cutting head having an array of cutting blades rotates around its axis, a strand winding device rotates around an axis intercepting the axis of the cutting head for positioning and winding continuous strand around the array of cutting blades, a toroidal strand guide member is spaced equidistant from the strand winding device to control the travel of the continuous strand to the strand winding device and cutting head, and a strand cut-off device is operative at time of tie-up of the continuous strand to the apparatus for severing the connection of the continuous strand from an air doffer used in the tie-up operation.

8 Claims, 7 Drawing Figures

APPARATUS FOR CUTTING CONTINUOUS STRAND

The present invention is directed to an apparatus for cutting continuous strand into predetermined lengths in the manner disclosed in the "Package Wind Cutter" patent, U.S. Pat. No. 4,519,281, and particularly to the arrangement for tie-up of the continuous strand to the strand winding device and the cutting head in the "Package Wind Cutter."

U.S. Pat No. 4,519,281 discloses an apparatus and method for cutting one or more strands into predetermined lengths, such as for cutting textile and industrial length filaments into staple fibers.

The apparatus disclosed in U.S. Pat. No. 4,519,281 is characterized by (a) a cutting head mounted for rotation around its axis at a predetermined speed, the cutting head having a plurality of cutting blades mounted and arranged to form a cutting zone of predetermined width and predetermined peripheral length to receive and store in cutting position multiple windings of strand for subsequent cutting into such predetermined lengths; (b) strand winding device mounted to rotate around an axis intercepting the axis of the cutting head in such manner that the strand winding device traverses back and forth along a predetermined width of the cutting zone during each revolution of the strand winding device, the strand winding device rotating at a significantly faster speed than the cutting head and the relative rotations of the strand winding device and the cutting head cooperating to position multiple crossing windings of the strand in the cutting position for such subsequent cutting; and (c) a device for applying pressure at predetermined locations against the windings and toward the cutting edges of the blades to cut the strand into such predetermined lengths.

In the apparatus disclosed in U.S. Pat. No. 4,519,281, the cutting edges of the cutting head may face radially outwardly to define an outwardly facing periphery of the cutting zone and the strand winding device rotates around the cutting head spaced outwardly from such outwardly facing periphery. The cutting edges of the cutting head may also face radially inwardly to define an inwardly facing periphery of the cutting zone and the strand winding device rotates around inside the cutting head spaced inwardly from such inwardly facing periphery. The axis of the strand winding device in each instance intercepts the axis of the cutting head at about the center of the cutting zone.

For purposes of the present invention, the cutting edges of the cutting head will face radially outwardly.

The device for applying pressure may comprise two pressure rollers each spaced opposite from the other roller and at a predetermined distance from the cutting edges. Each pressure roller also has a face width that extends over a portion of the cutting zone width essentially different from the other portion over which the face width of the other pressure roller extends and partially overlaps such other portion. The two pressure rollers together have a combined face width sufficient to extend at least across the cutting zone width. If desirable, one of the pressure rollers may have a greater diameter than the other pressure roller.

The method disclosed in U.S. Pat. No. 4,519,281 is characterized by the steps of (a) positioning and storing multiple windings of strand in cutting position along a predetermined width of a cutting zone of a predetermined width and a predetermined peripheral length formed by the cutting edges of a plurality of cutting blades mounted and arranged on a cutting head by crossing each winding along a helical path over a previous winding one or more times; and (b) applying pressure at predetermiend lcoations against the windings and toward the cutting edges of the blades to cut the strand into predetermined lengths. The steps of positioning and storing include rotating the cutting head around its axis at a predetermined speed of rotation and winding the strand into the cutting position at a greater speed than the predetermined speed of rotation of the cutting head. The step of winding the strand into the cutting position includes traversing the strand back and forth along a predetermined width of the cutting zone per each individual winding.

For purposes of the present invention, when the cutting edges face radially outwardly to define an outwardly facing periphery of the cutting zone, the strand is positioned and stored around such outwardly facing periphery.

In the package wind cutting apparatus disclosed in U.S. Pat. No. 4,519,281, the strand winding device delivers a large number of windings to the cutting head while the cutting head makes a single revolution relative to the two pressure rollers spaced from the cutting edges of the cutting head and spaced opposite each other. For example, the strand winding device may deliver enough strand material to the cutting head to form two hundred windings for each revolution of the cutting head. The windings are positioned side by side across the cutting blades and are wound in such manner that each winding will cross a previous winding one or more times. The multiple crossing windings fill the space between the cutting edges of the cutting blades and the pressure rollers, and the cutting head will cut in a single revolution as much strand material as is delivered to the cutting head during such single revolution.

Since the strand winding device can revolve at very high rates of speed, the package wind cutter can readily take up and store a significant length of strand in preparation for cutting from spinning cabinets at the speeds at which such spinning cabinets may be operated.

The manner in which the windings of strand are formed in the cutting position is similar to the manner in which windings are formed on a cross-wound package, and for this reason the staple fiber cutter of U.S. Pat. No. 4,519,281 is referred to as being a "package wind cutter."

As the strand winding device can revolve at very high rates of speed, the continuous strand leading to the strand hooking member on the circumferential edge of the strand winding device may balloon and "whip" through the air out of control and thus interfere with the smooth withdrawal of the continuous strand from the supply source. Excessive ballooning and whipping motion may also prevent the continuous strand from being wound at an even tension around the array of cutting blades on the cutting head. The fact that the continuous strand must travel to a point, such as the strand hooking member, on the circumferential edge of the strand winding device that moves in a large circular path means that the continuous strand must balloon to some extent. It is important to minimize contact of the continuous strand with the strand winding device so as to minimize abrasion of the continuous strand from tension buildup as it travels toward the cutting head. Since the boundary layer of air at the surface of the rotating dome of the strand winding device travels approximately the same speed as the dome, and since the air layers spaced farther away from the dome move at far lesser speeds than the rotating dome, the farther away the continuous strand is from the surface of the dome during its ballooning motion means more air resistance and hence excessive whipping motion.

An object of the invention, therefore, is to provide a strand guide member which will limit the extent that the ballooning and whipping motion will be transferred upstream of the strand winding device toward the strand supply source, as well as downstream toward the cutting head, and also to minimize the extent to which the strand will balloon out from the dome of the strand winding device.

In the operation connecting or tying up the continuously moving strand to the rotating strand winding device and then to the rotating cutter head for cutting the strand into predetermined lengths, it is also necessary to provide some initial fulcrum point to which the strand may be guided in its approach from the strand supply source, which is located in one direction, and by which it may also be restrained so that the path of the strand movement may be changed to cause the strand then to be positioned opposite the circumferential edge of the strand winding device, in alignment with the rotating cutting head without the strand coming into contact with the surface of the dome of the strand winding device. Since the strand hooking member on the circumferential edge of the strand winding device continuously changes location, i.e. moves in a large circular path, as the strand winding device rotates, the fulcrum point should also be at a location equidistant from the strand guiding member, no matter where it is located in its path of rotation with the circumferential edge of the strand winding device. The fulcrum point thus also becomes the focal point that is equidistant from the circumferential edge of the strand winding device.

Another object of the invention, therefore, is to provide a strand guide member at the focal point of equidistant from the circumferential edge of the strand winding device.

The strand guide member should also be so configured so that the continuously moving strand may be readily laced through it from an air doffer guided by an operator.

Still another object of the invention is to provide a strand guide member having an arrangement by which the continuously moving strand may be readily laced through the strand guide member.

After the continuously moving strand has become sufficiently tied up onto the rotating cutting head so that it will not slip loose, it then becomes necessary to disconnect in some manner the continuous strand from the air doffer.

A further object of the invention is to provide a strand cut-off device for the apparatus for severing the continuous strand from an air doffer during tie-up operation.

A still further object of the invention is to provide a protective shell for the strand winding device and the cutting head which also serves as a support for the strand guide member.

Other objects of the invention will become apparent from the disclosure that follows.

DISCLOSURE OF THE INVENTION

In accordance with the present invention, an apparatus is provided for cutting a continuous strand into predetermined lengths. The apparatus includes a cutting head mounted for rotation around its axis and having an array of spaced cutting blades projecting radially around the cutting head, and a strand winding device mounted to rotate around an axis intersecting the axis of the cutting head. The strand winding device comprises a dome extending arcuately across the diameter of the cutting head which defines a circumferential edge spaced radially outwardly from and around the cutting head. The circumferential edge is in line with the array of cutting blades and has a strand hooking member adapted to catch a continuous strand moved into its path of rotation and to guide the continuous strand to and around the array of cutting blades as the strand winding device rotates. The apparatus also includes a guide spaced at a position from the center of the dome of the strand winding device and equidistant from the circumferential edge of the strand winding device. The guide comprises a toroidal strand guide member having a curved interior annular guide surface and defines a diagonal slot extending from and across the outer diameter of the toroidal strand guide member and through the curved interior annular guide surface. The toroidal strand guide member is suitably supported at the aforementioned position from the center of the dome.

The toroidal strand guide member has at one axial end thereof and opposite from the curved interior annular guide surface an outer portion which flares outwardly to terminate in an annular flange. The annular flange has a circumferential portion removed to define along one axially extending edge in the remaining annular flange an essentially right-angled shoulder located adjacent one end of the diagonal slot and against which the aforementioned continuous strand is guided for entry into and along the diagonal slot and for exit out of the diagonal slot at the annular guide surface for circular guiding movement against and around the curved interior annular guide surface as the strand winding device rotates.

The apparatus has an indexing arrangement located on the apparatus at a position spaced outwardly a predetermined distance from the circumferential edge of the strand winding device and the cutting head for locating and positioning an air doffer to guide the continuous strand into the path of rotation of the strand hooking member for the latter to catch and guide the continuous strand. The indexing arrangement comprises a tubular member adapted to slidingly receive therein an air doffer and has means to limit the extent and direction to which such air doffer may be extended through the tubular member toward the cutting head.

During tie-up of the continuous strand to the cutting head a continuous strand portion extends between the cutting head and an air doffer from which the continuous strand portion is moving toward and around the cutting head as it rotates. The apparatus thus includes a strand cut-off device located on a fixed surface position on the apparatus closely adjacent to the cutting head and spaced from the extending continuous strand portion. The extending continuous strand portion becomes severed by the cut-off device as the cutting head continues to rotate and move the extending continuous strand portion into severing engagement with the cut-off device.

The arrangement for supporting the toroidal strand guide member comprises a protective shell positioned over and around the cutting head and the strand winding device, and the toroidal strand guide member is secured to and extends through the protective shell.

The protective shell defines through its wall a slot extending from the location of the toroidal strand guide member adjacent one end of the diagonal slot and terminating at an edge of the protective shell. The air doffer receiving arrangement is located at the termination of the slot in the protective shell spaced closely adjacent the path of the strand hooking member on the strand winding device as the strand winding device rotates. As heretofore indicated, the air doffer receiving arrangement is a tubular member and has means to limit the extend and direction to which the air doffer may be extended into the tubular member.

BRIEF DESCRIPTION OF THE DRAWINGS

The details of the invention will be described in connection with the accompanying drawings, in which.

DETAILED DESCRIPTION OF THE INVENTION (a) Prior Art—U.S. Pat. No. 4,519,281

Figure 1:
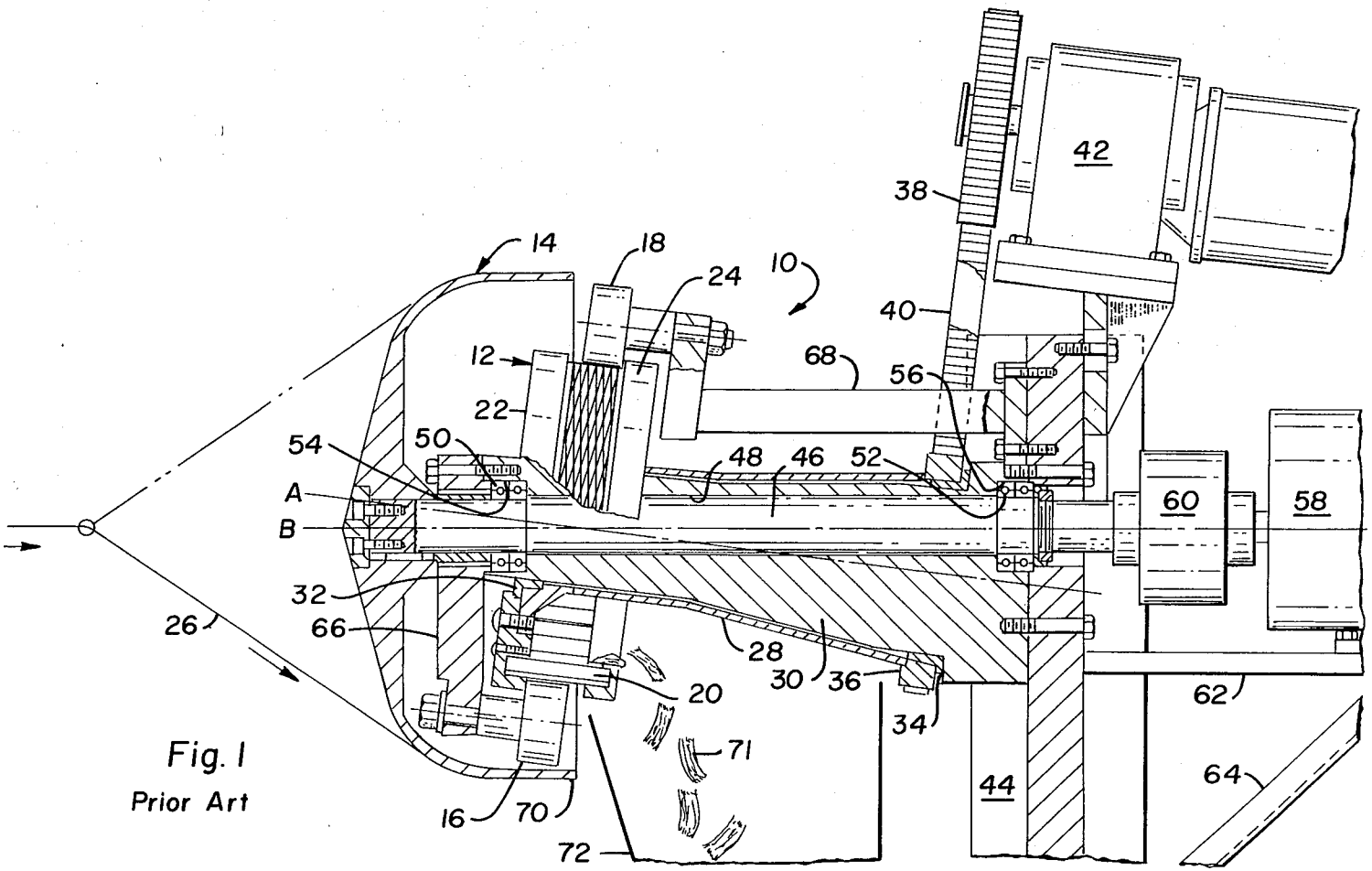
Fig. 1 Prior Art
FIG. 1 is an elevational view partly in crosssection and partly broken away of the staple fiber cutter of U.S. Pat. No. 4,519,281.
Figure 2:
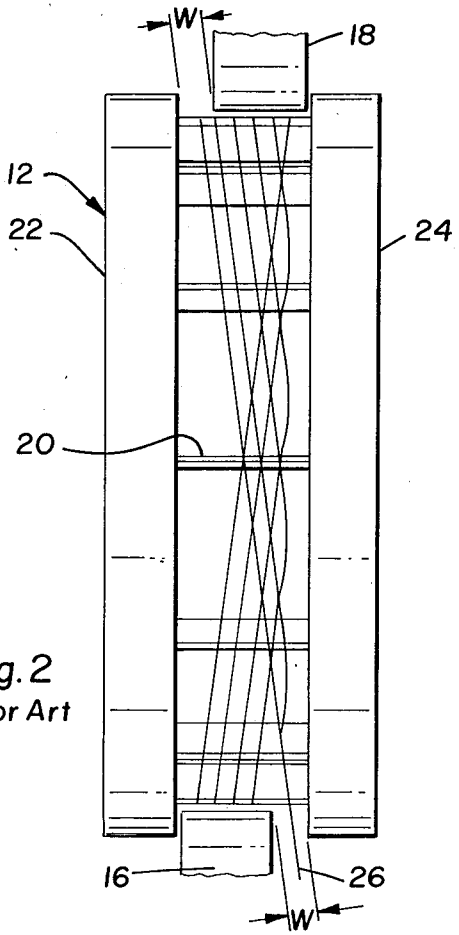
Fig. 2 Prior Art
FIG. 2 is an enlarged view of the cutting head of the staple fiber cutter of the staple fiber cutter shown in FIG. 1 and illustrating the pressure rollers with the pressure rollers only being shown in part and also illustrating the "window" through which the strand enters the cutting zone.

In reference to FIGS. 1 and 2 of the drawings showing the staple fiber cutter of U.S. Pat. No. 4,519,18, 10 designates the staple fiber cutter of the present invention. The cutter has a cutting head 12, which is mounted for rotation around its axis A; a strand winding device 14, which is mounted for rotation around its axis B; and two pressure roller 16,18, each spaced opposite the other and from the cutting head 12. The two axes A and B intercept each other in a manner to be described.

The cutting head 12 has a plurality of cutting blades 20 mounted between a disc 22 and an annular ring 24. The cutting blades are arranged around the cutting head at spaced intervals to form a cutting zone of predetermined width and predetermined peripheral length. The cutting zone receives and stores in cutting position multiple windings of strand 26 for subsequent cutting into predetermined lengths in a manner to be described. The cutting edges of the cutting blades face radially outwardly to define an outwardly facing periphery of the cutting zone.

The cutting head 12 is connected to the outer axial end of a rotatable support shaft 28, which is supported for rotation around a fixed supporting column 30 by sleeve bearings 32,34. The cutting head may rotate in the same direction as the strand winding device, or in the opposite direction. The rotatable support shaft and connected cutting head are rotated by the gear belt pulleys 36,38, gear belt 40 and motor 42. The fixed supporting column is suitably connected to a main support 44, and motor 42 is supported at one end of the main support. The main support may be connected to a floor (not shown).

The strand winding device 14 is suitably connected to the outer axial end of rotatable shaft 46, which is positioned for rotation within a cylindrical bore 48 extending through the fixed supporting column 30. Roller bearings 50,52 which are seated, respectively, within counterbores 54,56 that are formed, respectively, at opposite ends of the fixed supporting column, support the rotatable shaft 46 for rotation. A separate motor 58 drives the rotatable shaft 46 in rotation through a flexible coupling 60. The motor 58 is supported by brackets 62,64 which are connected to the main support 44.

The strand winding device 14 is preferably in the form of a lightweight, thin shell or dome-like member which can be rotated at high speeds but a minimum noise levels. The outer surface of the shell or dome-like member serves to guide the oncoming strand to the cutting head with minimal amount of friction. The strand winding device may also be in the form of a hollow tube (not shown in FIG. 1), but it has been found that as the tube is rotated at this speed the noise level is increased due to the resulting high pitches whistle caused by the tube whipping around through the air.

Pressure roller 16 is mounted for free rotation in place and is eccentrically supported for adjustment toward and away from the cutter blades on support arm 66, which is suitably secured to the outer axial end of the fixed supporting column 30. Pressure roller 18 is also mounted for free rotation in place, and is eccentrically supported for adjustment toward and away from the cutter blades on support arm 68, which is suitably secured to the main support 44.

Each pressure roller has a face width that extends over a portion of the cutting zone width that is essentially different from the other portion over which the face width of the other pressure roller extends, and partially overlaps such other portion. The purpose of such "overlap" is to ensure that the stored windings are completely cut across the width of the cutting zone. The combined face widths of the two pressure rollers, therefore, must be sufficient to extend at least across the cutting zone width.

In operation, the "strand" 26, which may comprise one or more spinning cabinet ends or one or more yarn package ends, is guided over the surface of the strand winding device 14, through a U-shaped guide 70 secured to the edge of the shell or dome-like member, so as to make the turn around the edge of the shell or dome-like member and then toward the cutting head 12 to be received and stored in cutting position in the cutting zone formed by the cutting blades between the disc 22 and annular ring 24. The U-shaped guide 70 should be made of some suitable material to resist wear and to minimize friction on the strand.

As previously mentioned, cutting head 12 rotates around its axis A and the strand winding device 14 rotates around its axis B, with the two axes intercepting each other. The location of such interception is at about the center of the cutting zone width, the cutting zone being, as also mentioned previously, of predetermined width and predetermined peripheral length. The "predetermined peripheral length" is formed, of course, by the cutting blades as they are spaced around the cutting head, whatever circumference is used. The "predetermined width" is formed by the exposed lengths of the cutting blades between the disc 22 and annular ring 24. Thus the center of the "predetermined width" where the two axes intercept will be at about the center of the cutting head midway of the exposed cutting blade length.

The strand 26 approaches the cutting zone through a "window" W (FIG. 2), which is a space that extends around the cutting head between the disc 22 and pressure roller at one side of the cutting head and the annular ring 24 and pressure roller 16 at the other side of the cutting head, so as to avoid interference with the pressure rollers as both of the cutting head and strand winding device make their respective, relative rotations. This "window" may be seen more clearly by reference to FIG. 2. Each winding, as positioned in the cutting position, crosses the cutting blades at a predetermined angle and also crosses any previous winding one or more times. As the strand winding device rotates around its axis B around the cutting head at a higher rate of speed, the cutting head also rotates around its axis A but at a slower rate of speed, with the consequence that each winding is positioned around the cutting blades 10 side by side with a previous winding and with the further result that the strand winding device in effect traverse back and forth along a "predetermined width" of the cutting zone. Such "predetermined width" could be the same as or less than the width of the cutting zone, depending upon the angle the strand makes to clear not only the two pressure rollers but also to avoid contacting the discs supporting the cutting blades. The windings are thus received and stored in cutting position until such time as the windings build up layers sufficiently thick enough to fill the space between the cutting edges of the cutting blades 20 and the pressure roller 16,18, at which time the pressure rollers apply pressure against the positioned strands and thereby force the innermost layers against and past the cutting edges in a severing action. The windings thus are cut in predetermined lengths or staple fiber lengths 71 and are discharged from the cutting head to the discharge funnel 72 positioned below the cutting head for subsequent conveyance elsewhere.

The manner in which the windings are formed in the cutting position is thus similar to the manner in which windings are formed on a cross-wound package, and for this reason this staple fiber cutter may be referred to as being a "package wind cutter" as heretofore indicated. This cross-winding arrangement serves at least three purposes: (1) It enables a large number of windings to be taken up in a relatively short time period; (2) it provides a method of distributing the windings in an orderly manner in the cutting zone; and (3) it provides a high degree of stability, as obtained by "locking in" the previous windings until they are ready to be cut. As heretofore described, the strand winding device may revolve around the cutting head two hundred times while the cutting head in the same length of time only makes one revolution.

By way of example, the angle between two axes A and B may be about 7 degrees and the helix angle that the windings make with respect to the cutting blades may be about 4.85 degrees. The purpose for the interception of the two axes occurring at about the center of the cutting zone width is so that the windings will be distributed evenly across the selected predetermined width of the cutting zone width.

The amount of strand windings received and stored preparatory to cutting will be dependent upon the amount of space between the cutting edges of the cutting blades 20 and the pressure roller 16,18. The pressure rollers, as heretofore indicated, may be adjusted to and from the cutting blades. An example of preferred spacing may be about $\frac{1}{4}$ inch (about 6.3 millimeters).

(b) The Present Invention

Figure 4:
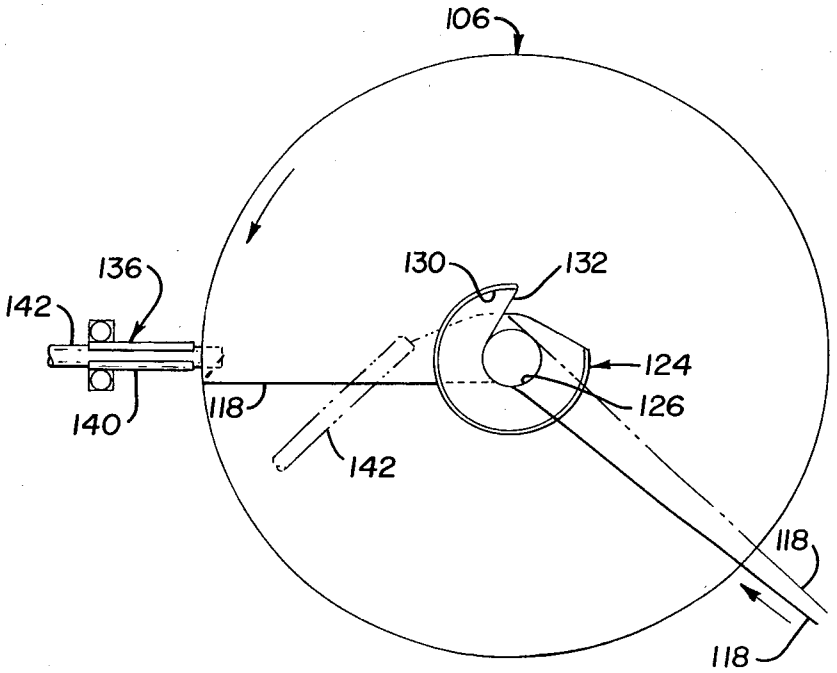
FIG. 4 is an end view of the staple fiber cutter showing only the toroidal strand guide member, the strand winding device, and air doffer receiving arrangement, and illustrating diagrammatically the thread-up or lacing of the staple fiber cutter by showing an air doffer and the continuous strand in different thread-up or lacing positions.
Figure 3:
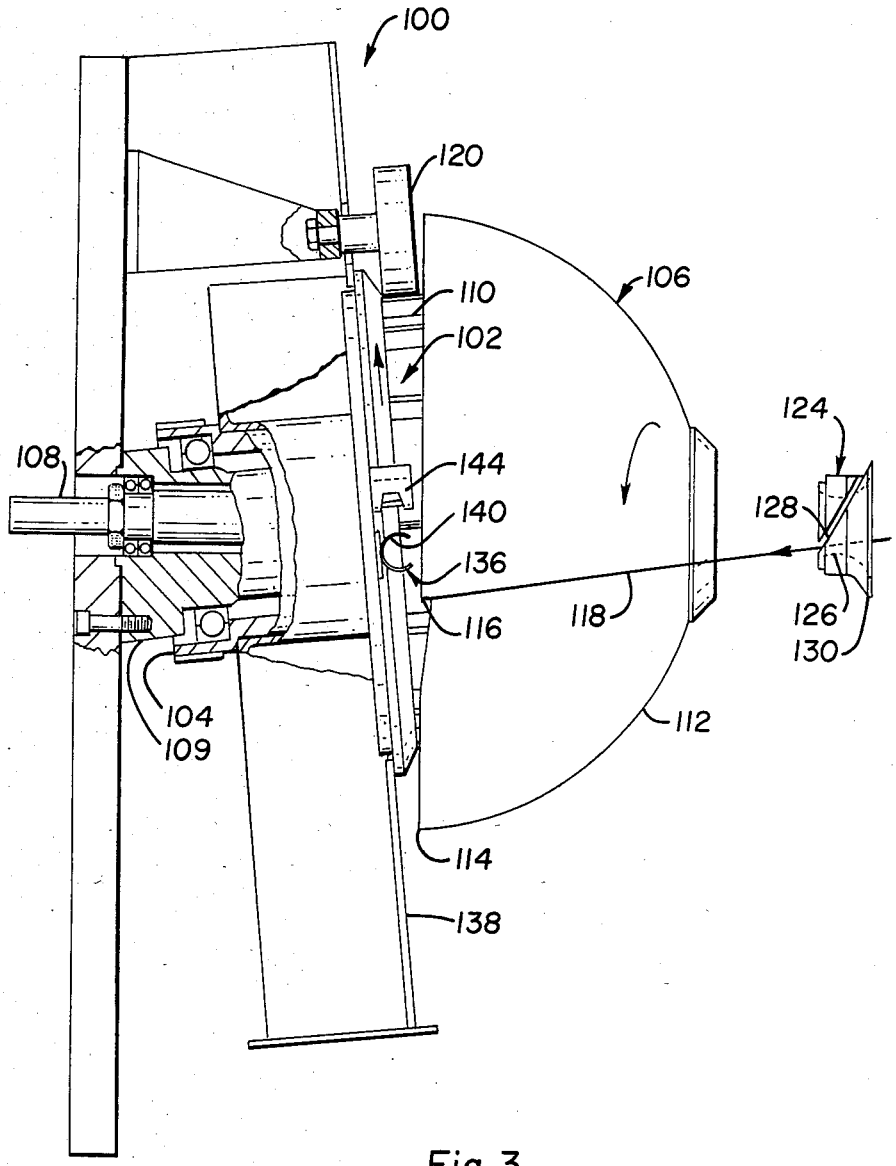
FIG. 3 is an elevational view of a portion of the staple fiber cutter of the present invention, partly broken away and in cross-section, illustrating the toroidal strand guide member centrally positioned with respect to the hub of the strand winding device, the tubular member of the air doffer receiving arrangement, the strand cut-off device and the strand hooking member.

In reference to FIGS. 3 and 4, the staple fiber cutter 100 comprises a cutting head 102 mounted on a rotor shaft 104 for rotation around its axis at a first speed and a strand winding device 106 mounted on a shaft 108 to rotate at a second speed around an axis intercepting the axis of the cutting head. The rotor shaft 104 and shaft 108 are suitably supported for rotation by column 109.

The cutting head 102 has an array of spaced cutting blades 110 projecting radially around the cutting head.

The strand winding device comprises a dome 112 extending arcuately across the diameter of the cutting head 102 and has a circumferential edge 114 spaced radially outwardly from and around the cutting head, which circumferential edge is also in line with the array of cutting blades 110 on the cutting head. The circumferential edge has a strand hooking member 116 for catching and guiding a continuous strand 118 to and around the array of cutting blades as the strand winding device 106 rotates. The dome is in a slightly different configuration than the one shown in FIG. 1 of the prior art so as to more closely approximate the configuration of the ballooning of the continuous strand.

A pair of oppositely positioned pressure rollers, (only pressure roller 120 being illustrated) serve to apply a cutting pressure against the strand wound around the array of cutting blades as the cutting head rotates past the pressure rollers.

The operation of the staple fiber cutter 100, its cutting head 102 and strand winding device 106, and the method for cutting continuous strand into predetermined lengths will not be repeated here because these operations have been sufficiently described in the discussion of FIGS. 1 and 2. Although the arrangement for driving the cutting head and strand winding device in their respective rotations in FIG. 3 is slightly different from that disclosed in FIG. 1 and 2, the result of the drive arrangement is essentially the same.

The toroidal strand guide member 124 of the invention may be suitably supported spaced from the center of the dome 112 of the strand winding device, as shown in FIG. 3, and also spaced equidistant from the circumferential edge 114 of the strand winding device. A "toroid" is a surface generated by the rotation of a plane closed curve about an axis lying in its plane and not intersecting it. In other words, the strand guide member 124 is essentially doughnut-shaped.

The toroidal strand guide member 124 has a curved interior annular guide surface 126, and defines a diagonal slot 128 extending from and across the outer diameter of the toroidal strand guide member and through the curved interior annular guide surface 126.

The toroidal strand guide member has at one axial end thereof and opposite from the curved interior annular guide surface 126 an outer portion which flares outwardly to terminate in an annular flange 130. The annular flange has a circumferential portion removed to define along one axially extending edge in the remaining annular flange an essentially right-angled shoulder 132 located adjacent one end of the diagonal slot 128.

The toroidal strand guide member 124 serves several important functions which will be discussed later in the description of the tie-up operation.

The circumferential edge 114 of the strand winding device 106, as heretofore mentioned, has a strand hooking member 116, which may either be secured to the circumferential edge along the outside surface thereof or may be formed integrally in the circumferential edge as shown in the drawings. The purpose of the strand hooking member 116 is to catch the continuous strand when the continuous strand is guided into its path and then to guide the strand to and around the array of cutting blades 110 as the strand winding device 106 rotates. The manner in which the continuous strand is guided into the path of the strand hooking member will be discussed later in the description of the continuous strand tie-up operation to the apparatus.

An indexing arrangement 136 is provided on the apparatus and may be secured to the surface of the frame 138 at a position spaced outwardly a predetermined distance from the circumferential edge 114 of the strand winding device 106 and from the cutting head 102 for assisting an operator to position an air doffer for the purpose of guiding the continuous strand into the path of rotation of the strand hooking member 116. The indexing arrangement comprises a tubular member 140 which is partially open along the length thereof along one side, as shown in FIG. 3, to enable the continuous strand to continue passing uninterruptedly into the air doffer and is adapted to slidingly receive therein the air doffer. The indexing arrangement 136 could also be only a mark on the apparatus to serve as an "index" or guide for the operator in positioning the air doffer during the tie-up operation. For purposes of safety, however, an arrangement similar to the one shown in the drawings will serve to control the direction of the air doffer and to prevent the air doffer from coming into contact with moving parts.

The forward edge of the tubular member serves to limit the extent to which the air doffer may be extended through the tubular member toward the cutting head, and the tubular member serves to control the direction of the air doffer at the last critical moments of the tie-up operation. The forward edge is engaged by the housing portion (not shown) of the air doffer when the operator guides the tubular portion of the air doffer into the tubular member 140. An air doffer is shown in FIG. 4 at 142. A more detailed discussion of the cooperation between the indexing arrangement 136, air doffer 142 and strand hooking member 116 will be provided later in the description of the operation of the tie-up of the continuous strand to the apparatus.

A strand cut-off device 144 is also located on the surface of the frame 138 closely adjacent to the cutting head and spaced from the continuous strand portion 146, which extends between the cutting head and an air doffer during the tie-up of the continuous strand to the apparatus. A discussion of this device will be given in the description of tie-up operation.

TIE-UP OPERATION

When connecting one or more continuous strands 118 to the staple fiber cutter 100 for cutting into predetermined lengths, an operator may use an air doffer, such as the one shown at 142, for picking up the end of a continuous strand from a suitable source (not shown) such as a yarn package or spinning cabinet. The continuous strand then is forced to move into the air doffer toward a waste receptacle (not shown) in a manner well known in the art.

The operator uses the air doffer to guide the continuous strand 118 to the toroidal strand guide member 124 where the continuous strand is laced into the latter by first positioning the strand against the right-angled shoulder 132 for movement of the strand into the diagonal slot 128 of the toroidal strand guide member. The operator then guides the air doffer to a position spaced opposite the indexing arrangement 136. The pull by the air doffer on the continuous strand serves to maintain tension on the continuous strand to hold it against one of the sides of the diagonal slot in the toroidal strand guide member until the continuous strand moves safely into the curved interior annular guide surface. The continous strand at this time has not yet been brought into contact with the surface of the dome 112 of the strand winding device 106. The operator then uses the indexing arrangement to guide the air doffer into appropriate position for moving the continuous strand into the rotating path of the strand hooking member 116 without the air doffer inadvertently also making physical contact with the rotating strand winding device or the rotating cutting head. When the air doffer is inserted into the tubular member 140, the continuous strand is then brought into contact with the dome of the strand winding device and is caused to bend around and move inwardly of the circumferential edge 114 where the strand hooking member 116 rotates into position catching the continuous strand and guiding it to and around the array of cutting blade 110 of the cutting head 102 as the strand winding device 106 rotates.

Since the strand winding device 106 rotates many times for each rotation of the cutting head 102, the strand windings are soon secured to and around the array of cutting blades so that the windings will not slip loose from the cutting head. The continuous strand 118 now runs from the supply source (not shown) through the toroidal strand guide member 124 over a portion of the arcuate surface of the dome 112 of the strand winding device 106 to the strand hooking member 116 on the circumferential edge 114 of the strand winding device 106, and finally to and around the array of cutting blades 110 on the cutting head 102.

The toroidal strand guide member 124 now serves to maintain the continuous strand 118 equidistant from the circumferential edge of the strand winding device 106 so that the continuous strand travels the same distance to the strand winding device wherever the strand hooking member 116 happens to be positioned as the strand winding device rotates. Since the toroidal strand guide member is at the focal point of the circumferential edge, this serves to prevent the continuous strand from seesawing back and forth, as would otherwise occur if the strand had to travel a greater distance to one side of the strand winding device than to the opposite side. This also promotes even tension upon the strand as it is wound around the array of cutting blades on the cutting head.

The toroidal strand guide member 124 has a smooth curved annular interior guide surface 126 against which and around which the continuous strand travels from the source (not shown) to and through the strand guide member. The opposite surfaces of the diagonal slot against which the continuous strand rides while the continuous strand is being guided by an air doffer for tie-up connection to the strand winding device and the cutting head are also smooth.

The toroidal strand guide member also serves to limit and control the extent of ballooning and hence any excessive "whipping" motion the continuous strand would otherwise make toward the supply source in one direction and toward the cutting head in another direction as the strand winding device and its strand guiding member rotate.

Figure 7:
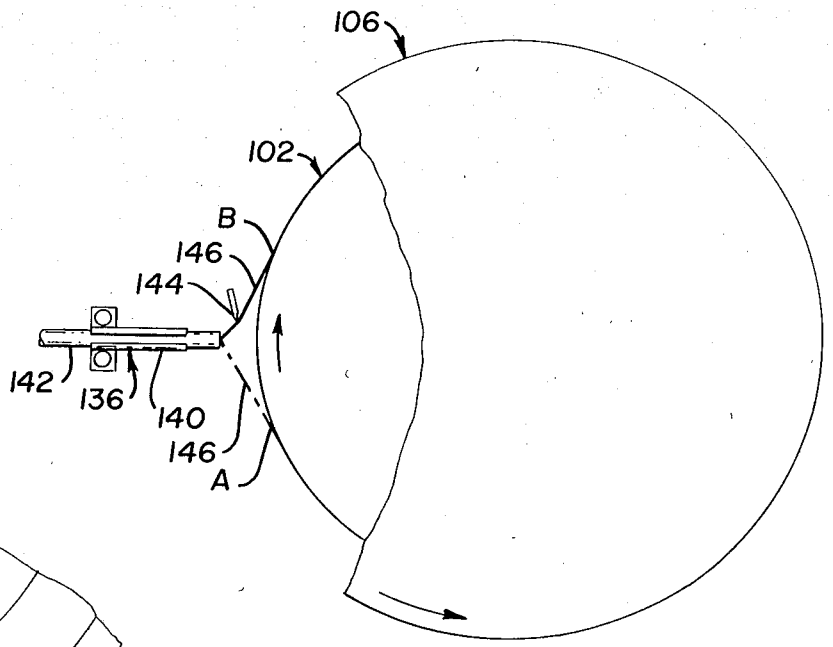
FIG. 7 is a fractional view of the embodiment shown in FIG. 5 illustrating the strand winding device partly broken away to show the cutting head and the operation of the strand cut-off device.

This now leaves the aforementioned continuous strand portion 146 (shown in FIG. 7) which extends between the cutting head 102 and the air doffer 142 and which now must be discontinued from the air doffer. FIG. 7 illustrates in phantom line and in solid line the operation of the strand cut-off device. Since the strand winding device, for example, may be rotating about 50 revolutions for each revolution of the cutting head, the speed of rotation for the cutting head is therefore relatively slow. The strand winding device 106, as viewed in FIG. 7, will be rotating counterclockwise, as shown by the arrow while the cutting head 102 will be rotating clockwise, as shown by the arrow. The continuous strand portion 146 shown in phantom lines becomes locked in by other strand windings at about point A. The strand cut-off device 144 is located closely adjacent to the cutting head 102 and is spaced from the continuous strand portion 146 as it extends between the cutting head and the air doffer. As the cutting head continues to rotate clockwise and thus move the point where the continuous strand portion has become locked in to the cutting head toward and past the location of the strand cut-off device to about point B, the extending continuous strand portion is moved toward the strand cut-off device for severing engagement with the strand cut-off device. When the rotating cutting head causes the extending continuous strand portion 146 to pass opposite the location of the air doffer and the tubular member 140 in which the air doffer is temporarily received, the continuous strand portion starts pulling strand out of the air doffer from the waste receptacle (not shown). The pulling-out motion only lasts, of course, for a very short instant, from the time it takes the locked-in portion to reach point B from a position directly opposite the air doffer. The resulting tail from the continuous strand portion remaining between the strand cut-off device and the cutting head is therefore relatively short and is soon wrapped into the strand windings by other windings as the strand winding device rotates rapidly around the cutting head.

The cutting head 102 may also be caused to rotate in the same direction as the strand winding device 106, in which event the strand cut-off device 144 would be located appropriately with respect to the cutting head so that the cutting head moves the continuous strand portion into severing engagement with the strand cut-off device in the manner described above.

Similarly, if the strand winding device were caused to rotate clockwise, the strand hooking member 116 would be formed appropriately to catch and guide the continuous strand to and around the cutting head.

Also, the indexing arrangement 136 could be located on the opposite side of the staple fiber cutter from where it is presently shown in the drawings.

ALTERNATE AND PREFERRED EMBODIMENT

Figure 5:
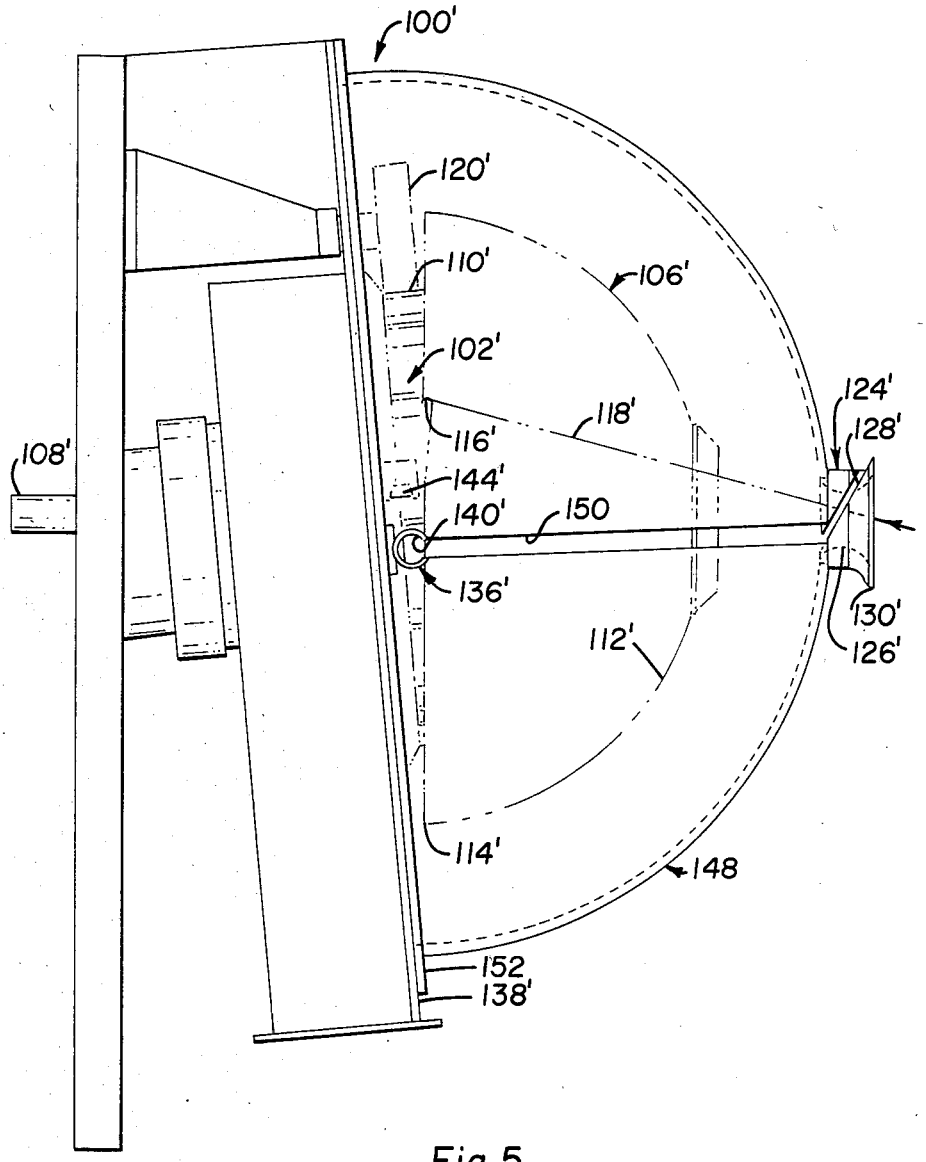
FIG. 5 is an alternate but preferred embodiment of the staple fiber cutter shown in FIG. 3 and illustrates a protective shield, which may be transparent, extending over the strand winding device and cutting head and serving as a support for the toroidal strand guide member.
Figure 6:
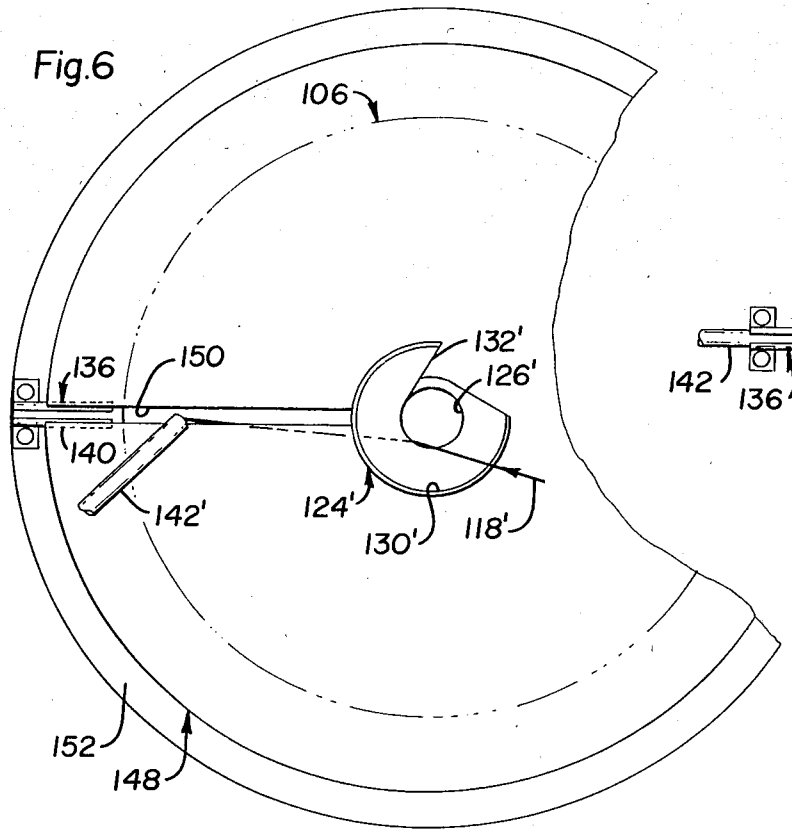
FIG. 6 is a fractional end view of the embodiment shown in FIG. 5 illustrating one of the initial thread-up or lacing positions of the staple fiber cutter with an air doffer.

FIGS. 5 and 6 show not only an alternate embodiment of the invention but also a preferred embodiment for the purpose of safety. A protective shell 148 is preferably provided to protectingly arch over the strand winding device 106' and cutting head 102' to prevent the operator and others from accidentally coming into contact with the rotating parts of the staple fiber cutter 100'. The protective shell also serves to support the toroidal strand guide member 124' at a position appropriately spaced from the strand winding device.

The protective shell 148 may be shaped differently from the dome-like member shown in the drawings. For example, it may be box-like. A dome, however, may be more easily constructed by state of the art plastic construction methods.

The protective shell defines through its wall a slot 150, which extends from the location of the toroidal strand guide member 124' adjacent one end of the diagonal slot 128' and which terminates at an edge of the protective shell, as shown in FIG. 5. The protective shell is suitably flanged as shown at 152 for securing the protective shell to the frame 138'. The means (not shown) for securing the protective shell preferably enable an operator to readily remove the protective shell from the apparatus for servicing the staple fiber cutter.

The protective shell may also be made of transparent material so that an operator may readily see if an problems need correcting, such as an undesired breakage of a portion of the continuous strand.

TIE-UP OPERATION—ALTERNATE EMBODIMENT

The tie-up of the continuous strand 118' to the staple fiber cutter 100' is essentially the same as described with respect to FIGS. 3 and 4, except that the operator uses the slot 150 in the protective shell 148 as a guide for the air doffer 142' and continuous strand 118'. The operator guides the air doffer spaced from the slot 150 in such manner as to guide the continuous strand from the toroidal strand guide member 124 into and along the slot 150 until at the termination of the slot he inserts the air doffer into the tubular member 140'.

The operation of severing the continuous strand portion from the air doffer after tie-up is the same operation as previously described with respect to FIG. 7.

All like parts previously described with respect to FIGS. 3 and 4 are given the same reference numbers, but are shown with prime marks in FIGS. 5 and 6.

The invention has been described in detail with particular reference to preferred embodiments thereof, but it will be understood that variations and modifications can be effected within the spirit and scope of the invention.

I claim:

1. An apparatus for cutting a continuous strand into predetermined lengths comprising a cutting head mounted for rotation around its axis and having an array of spaced cutting blades projecting radially around the cutting head, a strand winding device mounted to rotate around an axis intersecting the axis of the cutting head and comprising a dome extending arcuately across the diameter of the cutting head and defining a circumferential edge spaced radially outwardly from and around the cutting head, said circumferential edge being in line with the array of cutting blades and having a strand hooking member adapted to catch a continuous strand moved into its path of rotation and guide the continuous strand to and around the array of cutting blades as the strand winding device rotates, guide means spaced at a position from the center of the dome of the strand winding device and equidistant from said circumferential edge, said guide means comprising a toroidal strand guide member having a curved interior annular guide surface and defining a diagonal slot extending from and across the outer diameter of the toroidal strand guide member and through the curved interior annular guide surface; and means for supporting said guide means at said position.

2. An apparatus for cutting a continuous strand as defined in claim 1 and wherein said toroidal strand guide member has at one axial end thereof and opposite from said curved interior annular guide surface an outer portion which flares outwardly to terminate in an annular flange, said annular flange having a circumferential portion removed to define along one axially extending edge in the remaining annular flange an essentially right-angled shoulder located adjacent one end of said diagonal slot and against which said continuous strand is guided for entry into and along said diagonal slot and for exit out of said diagonal slot at said annular guide surface for circular guiding movement against and around said curved interior annular guide surface as said strand winding device rotates.

3. An apparatus for cutting a continuous strand as defined in claim 1 and comprising indexing means located on said apparatus at a position spaced outwardly a predetermined distance from said circumferential edge of said strand winding device and said cutting head for locating and positioning an air doffer to guide said continuous strand into said path of rotation of said strand hooking member for the latter to catch and guide said continuous strand.

4. An apparatus for cutting a continuous strand as defined in claim 3 wherein said indexing means comprises a tubular member adapted to slidingly receive therein said air doffer and having means to limit the extent and direction to which said air doffer may be extended through said tubular member toward said cutting head.

5. An apparatus for cutting a continuous strand as defined in claim 1 wherein during tie-up of the continuous strand to the cutting head a continuous strand portion extends between said cutting head and an air doffer from which said continuous strand portion is moving toward and around said cutting head as it rotates, and comprising a strand cut-off device located on a fixed surface position on said apparatus closely adjacent to said cutting head and spaced from said extending continuous strand portion, said extending continuous strand portion being severed by said cut-off device as said cutting head continues to rotate and move said extending continuous strand portion into severing engagement with said cut-off device.

6. An apparatus for cutting a continuous strand as defined in claim 1 wherein said means for supporting said toroidal strand guide member comprises a protective shell positioned over and around the cutting head and the strand winding device, and said toroidal strand guide member is secured to and extends through said protective shell.

7. An apparatus for cutting a continuous strand as defined in claim 6 wherein said protective shell defines through its wall a slot extending from the location of said toroidal strand guide member adjacent one end of said diagonal slot and terminating at an edge of the protective shell, and an air doffer receiving means is located at the termination of said slot in said protective shell spaced closely adjacent said path of said strand hooking member on said strand winding device as said strand winding device rotates.

8. In an appratus for cutting a continuous strand as defined in claim 7 wherein said air doffer receiving means is a tubular member adapted to receive said air doffer and having means to limit the extent and direction to which the air doffer may be extended into said tubular member.

* * * * *